US006871985B2

(12) United States Patent
Humphrey

(10) Patent No.: US 6,871,985 B2
(45) Date of Patent: Mar. 29, 2005

(54) PORTABLE OUTDOOR POST LIGHTING FIXTURE

(75) Inventor: Neall W. Humphrey, El Dorado Hills, CA (US)

(73) Assignee: Craftmade International, Inc., Coppell, TX (US)

( * ) Notice: Subject to any disclaimer, the term of this patent is extended or adjusted under 35 U.S.C. 154(b) by 0 days.

(21) Appl. No.: 10/127,397

(22) Filed: Apr. 22, 2002

(65) Prior Publication Data

US 2003/0198055 A1 Oct. 23, 2003

(51) Int. Cl.[7] ..... F21S 13/10

(52) U.S. Cl. ..... 362/431; 362/437; 362/410; 362/411; 362/414; 362/401; 362/433; 248/346.2; 52/726.4

(58) Field of Search ..... 362/431, 437, 362/441, 410, 411, 414, 401, 433, 457, 395; 248/346.2; 52/726.4; 473/479

(56) References Cited

U.S. PATENT DOCUMENTS

| | | | | | |
|---|---|---|---|---|---|
| 3,015,720 | A | * | 1/1962 | Silverman | 362/431 |
| 5,217,298 | A | * | 6/1993 | Jackson et al. | 362/226 |
| 6,217,199 | B1 | * | 4/2001 | Lo et al. | 362/414 |

* cited by examiner

*Primary Examiner*—Sandra O'Shea
*Assistant Examiner*—Bertrand Zeade
(74) *Attorney, Agent, or Firm*—Haynes and Boone, LLP

(57) ABSTRACT

A portable outdoor post lighting fixture is described, having a base adapted to retain the post lighting fixture in an upright position.

4 Claims, 3 Drawing Sheets

PORTABLE OUTDOOR POST LIGHTING FIXTURE

BACKGROUND

The present disclosure relates generally to an outdoor post lighting fixture, and more particularly, to a portable outdoor post lighting fixture.

Conventional outdoor post lighting fixtures are permanently secured to the ground. While providing sufficient illumination for immediately adjacent areas, conventional outdoor post lighting fixtures are understandably immovable. Such immobility can be disadvantageous. For example, being fixed, a conventional outdoor post lighting fixture for providing typical front entry way or sidewalk illumination cannot be used to augment a garden party or back yard wedding. Moreover, cementing conventional outdoor post lighting fixtures into the backyard for such events would be impractical. Likewise, anchoring conventional outdoor post lighting fixtures into a private or public park to form a grassy avenue would be cost prohibitive if the park only holds a few night-time festivals per year. Furthermore, such permanent fixation of conventional outdoor post lighting fixtures would lessen the utility of the park during the day.

Therefore, what is needed is the ability to retain the aesthetic qualities of the conventional outdoor post lighting fixtures, while integrating portability.

DESCRIPTION

Figure 1:
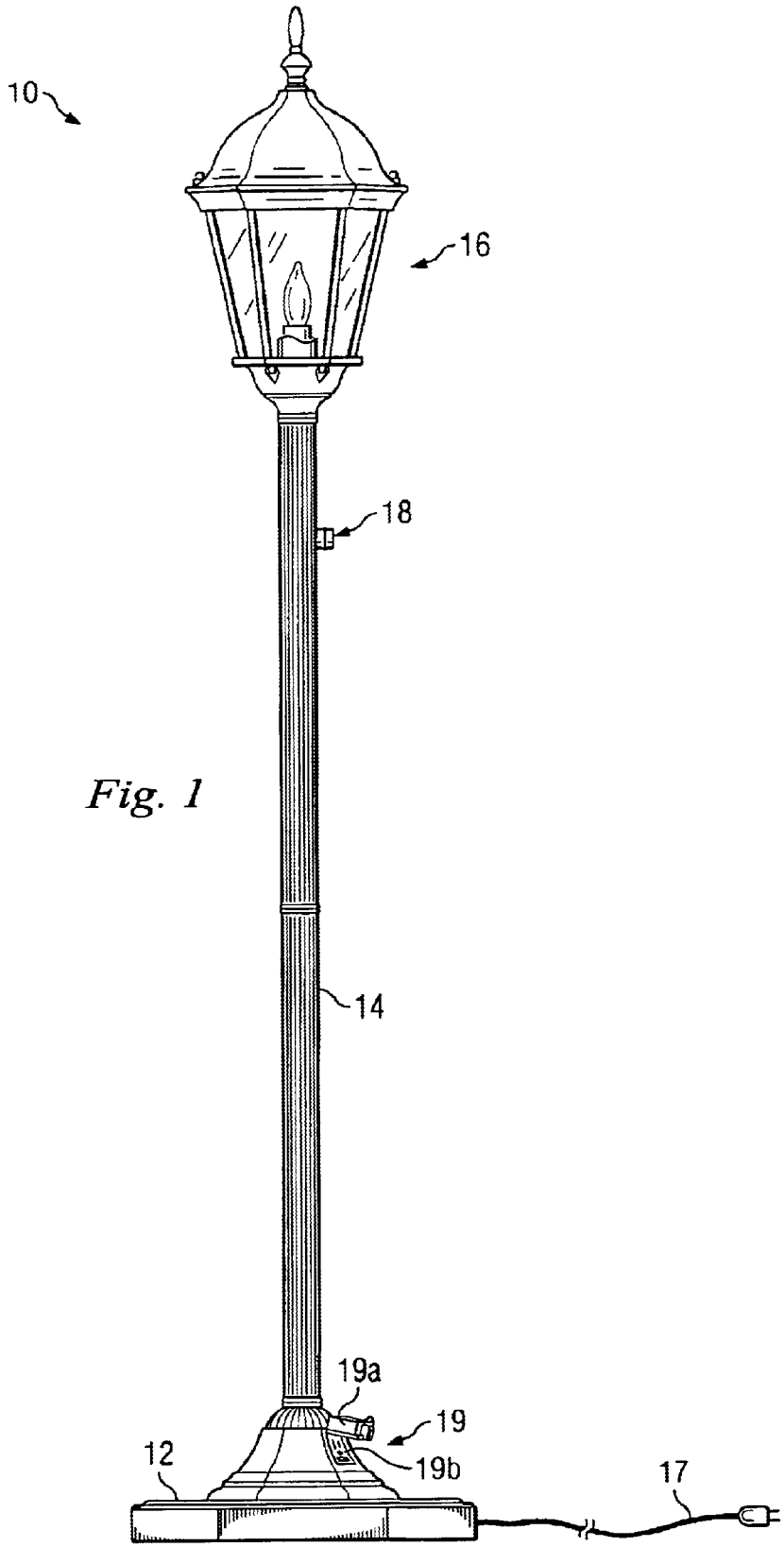
FIG. 1 is a front plan view of a portable outdoor post lighting fixture ("post lighting fixture") according to one embodiment of the present disclosure.

Referring to FIG. 1, a post lighting fixture according to one embodiment of the present disclosure is generally given the reference numeral 10. The post lighting fixture 10 comprises a base 12 for supporting the post lighting fixture, as will be discussed in greater detail with reference to FIGS. 2*a*–2*d*. Moreover, the post lighting fixture 10 may have any of the decorative features normally associated with conventional outdoor post lighting fixtures, such as finials, cross bars, arms, rings, balls, fluting, and the like. In some embodiments, it is desirable that the post lighting fixture 10 resemble conventional outdoor post lighting fixtures, however, it is understood that, unlike conventional outdoor post lighting fixtures, the base 12 allows the post lighting fixture to be portable. Although the base 12 is depicted as a hexagonal shape for purposes of illustration, it is understood that the base may take a variety of shapes.

A post 14 extends from the base 12 for receiving and supporting a lighting assembly 16. The post 14 may be one-piece or several connected pieces. The post 14 may attach to the base 12 and the lighting assembly 16 in a variety of ways, including a threaded or snap connection.

In one embodiment, an electrical cord 17 is operably attached to the lighting assembly 16. However, it is understood that a variety of conventional powering means are contemplated for the lighting assembly 16. The lighting assembly 16 may also have a conventional switch for controlling illumination. For example, a conventional dimmer switch 18 may operably attach to the post 14 for providing a means for altering the intensity of light emitted by the lighting assembly 16. Furthermore, in one embodiment, a conventional electrical outlet 19, comprising a cover 19*a* and a receptacle 19*b*, may be disposed on the base 12 for providing a power source for an electrical device. Electrical devices are any conventional device that uses power, such as a radio.

Referring to FIGS. 2*a*–2*d*, the base 12 is free-standing, and supports the post 14 (FIG. 1) and lighting assembly 16 (FIG. 1) in an upright position. The base 12 has a pedestal portion 20 for engaging an outdoor surface, and a receptacle portion 22. An attachment means 24 is associated with the receptacle portion 22 to engage and retain the post 14. The attachment means 24 is illustrated as a threaded portion which would engage a threaded portion of the post 14 (not shown), but understandably, the attachment means could be any conventional means for attaching two parts, either removably or permanently. It is understood that the portions 20 and 22 refer to regions of the base 12, and in practice may be formed from one piece.

Figure 2A:
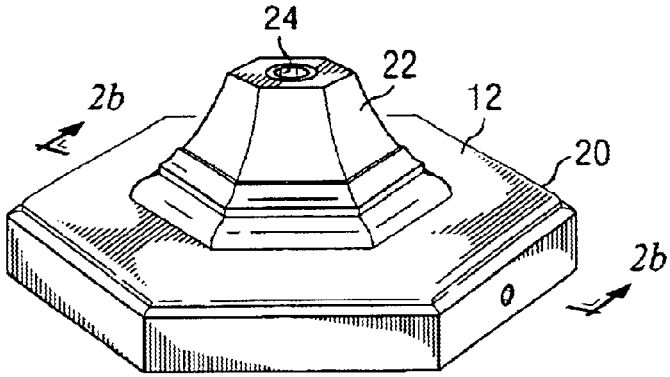
FIG. 2*a* is a perspective view of the base of the post lighting fixture of FIG. 1.
Figure 2B:
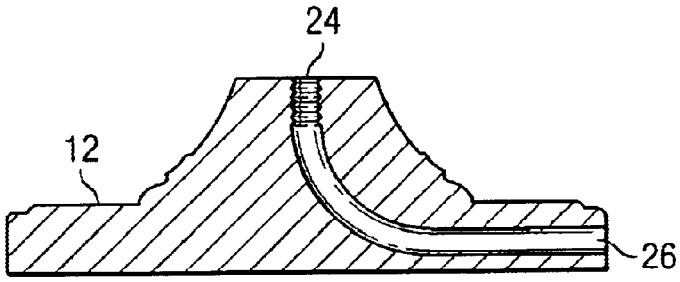
FIG. 2*b* is a front cross-sectional view of the base.

Turning to FIG. 2*b*, the base 12 may be substantially solid to provide sufficient weight to stabilize the post lighting fixture 10. A passage 26 is disposed in the base 12 to accommodate the wiring (not shown) associated with the electrical cord 17.

Figure 2C:
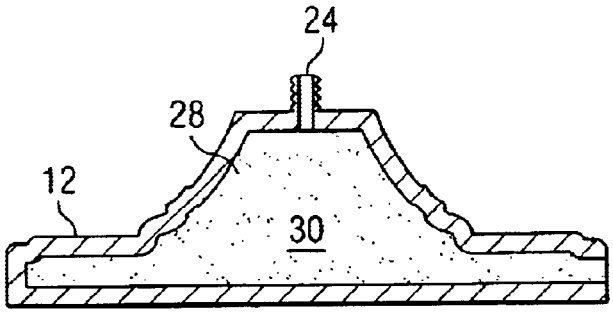
FIG. 2*c* is a front cross-sectional view of an alternative embodiment of the base.

Turning to FIG. 2*c*, in an alternative embodiment, the base 12 may be partially hollow, defining a chamber 28. The chamber 28 may be filled with a weighting agent 30, such as sand or water, to provide sufficient weight to stabilize the post lighting fixture 10. A drain (not depicted) may be associated with the chamber 28. FIG. 2*c* depicts another example of an attachment means, given the reference numeral 24'.

Figure 2D:
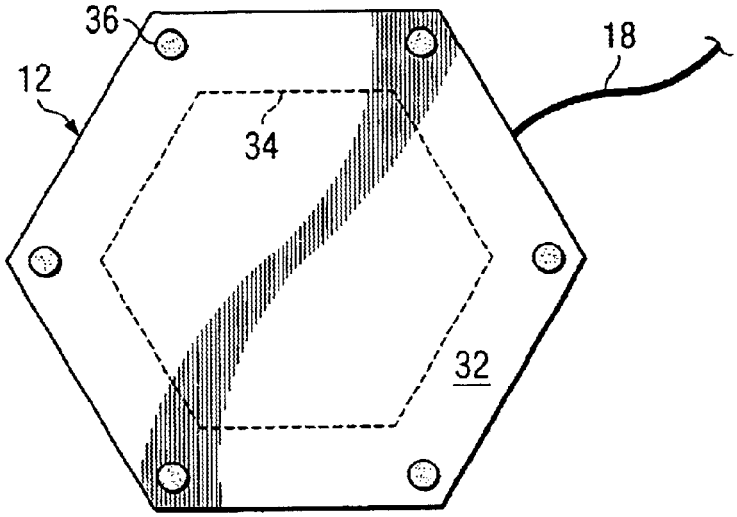
FIG. 2*d* is a bottom plan view of the base.

Referring now to FIG. 2*d*, the bottom of the base 12 defines a substantially smooth and planar surface 32. In one embodiment, an access door 34 is provided for providing access to the inside of the base 12.

A plurality of grips 36 may alternatively be disposed on the surface 32 for engaging outdoor surfaces. In one embodiment, the grips 36 may be cleats for engaging a soft surface, such as a lawn. In another embodiment, the grips 36 may be felt pads for engaging a slick surface, such as tile.

Figure 3:
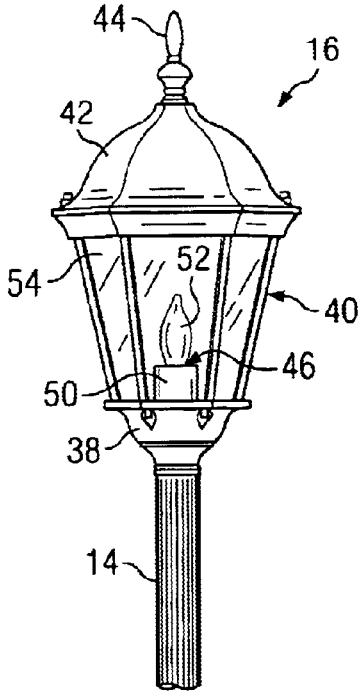
FIG. 3 is a detail view of a lighting assembly of the post lighting fixture.

Referring to FIG. 3, the lighting assembly 16 comprises a lower portion 38, a light portion 40, and a cover portion 42. A decorative finial 44 is disposed atop the cover portion 42, however, it is understood that any other conventional decorative features, or none, could be associated with the lighting assembly 16.

A socket assembly 46 is disposed inside the light portion 40. The socket assembly 46 comprises a light socket 48 disposed within a head 50. In the present embodiment, the light socket 48 is a medium base, and retains a conventional medium base light bulb 52. However, other base sizes are contemplated.

A transparent shield 54 surrounds the socket assembly 46 of the light portion 40.

In operation, the post lighting fixture 10, or a group of post lighting fixtures substantially similar to post lighting fixture 10, is placed in a desirable outdoor area, and the lighting assembly 16 activated to illuminate the area. After placement, if desired, the post lighting fixture 10 may be readily moved to another outdoor area. Likewise, if used for a special event, the post lighting fixtures may be moved away at the conclusion of the event. If the user subsequently develops a second outdoor illumination purpose, the user may simply move the post lighting fixture 10 to a corresponding area, and activate the lighting assembly 16 to illuminate that area.

Although only a few exemplary embodiments of this invention have been described in detail above, those skilled in the art will readily appreciate that many other modifications are possible without materially departing from the novel teachings and advantages of the invention. Accordingly, all such modifications are intended to be included within the scope of this invention as defined in the following claims.

What is claimed is:

1. A portable outdoor post lighting fixture, comprising:

a lighting means;

a post associated with the lighting means; and a free-standing base connected to the lower distal end of the post, the base having a substantially planar surface for resting on an outdoor surface, the base defining a chamber wherein the chamber is filled with a weighting agent, thereby retaining the post lighting fixture in an upright position.

2. The post lighting fixture of claim 1 further comprising a dimmer switch.

3. The post lighting fixture of claim 1 wherein the base is not permanently connected to any outdoor surface.

4. The post lighting fixture of claim 1 wherein the bottom of the base has grips.

* * * * *